United States Patent [19]

Liguori

[11] 3,939,445

[45] Feb. 17, 1976

[54] BALL UNIVERSAL JOINT FOR WAVE GUIDES

[75] Inventor: Mario Liguori, Milan, Italy

[73] Assignee: Messrs Elettronica Aster S.r.l., Milan, Italy

[22] Filed: Sept. 13, 1974

[21] Appl. No.: 505,791

[30] Foreign Application Priority Data

Mar. 1, 1974 Italy ..... 48874/74

[52] U.S. Cl. ..... 333/98 TN; 333/1; 333/98 BE

[51] Int. Cl.[2] ..... H01P 1/02; H01P 1/28

[58] Field of Search ..... 333/98 TN, 98 BE, 98 R, 333/1, 6, 9

[56] References Cited

UNITED STATES PATENTS

| | | | |
|---|---|---|---|
| 2,947,955 | 8/1960 | Bellamy et al | 333/98 TN |
| 2,969,513 | 1/1961 | Brennalt | 333/98 TN |
| 3,786,378 | 1/1974 | Liguori | 333/98 TN |

*Primary Examiner*—James W. Lawrence
*Assistant Examiner*—Marvin Nussbaum

[57] ABSTRACT

A ball universal joint for wave guides comprising a package of plates, each of which having therein a rectangular cross-section hole a quarter-wave length, the plates being compressed on one another by interposing balls separating and restraining the plates and being rotably carried in a rigid framework. Intermediate these plates, a rigid body is positioned and is fast with the framework and provides a curved intermediate step, in which a curved rectangular cross-section hole of average half-wave length is formed. The two end faces of the rigid body lie on planes forming a 90° angle therebetween, so that the axes of the end plates in the plate package form a 90° angle therebetween.

3 Claims, 7 Drawing Figures

BALL UNIVERSAL JOINT FOR WAVE GUIDES

This invention relates to a ball univeral joint for wave guides.

It is known that aircraft radar antennas are supported by universal joints provided with ball bearings, the shafts of which having coaxial cables therein coupled by transitions to the wave guides, and it is also known that both coaxial cables and transitions are very bad passages for radar microwaves.

U.S. Pat. No. 3,786,378, assigned to the same assignee of this invention, discloses a rotary stepped joint for wave guides without both coaxial cables and transitions and which for its own nature forms also an actual dual thrust and journal ball bearing.

However, in order to best perform in aircraft radar antennas the functions of both ball bearing and wave guide, such a joint would require substantial improvements.

In an aircraft universal joint wave guide, wherein the reduction in overall size and weight should be maximized, it is very important that the universal joint spider be small and rugged.

In the rotary joint of the above mentioned U.S. patent, each plate comprising each of the joint steps is passed through by a number of cylindrical holes, generally three holes, each of such holes accomodating a ball of a diameter slightly larger than the thickness of said plates, such balls separating and restraining the adjacent plates to one another. This involves that the diameter of each plate should be comparatively large, having to be equal to the diagonal of the cross-section for the rectangular hole comprising the wave guide, plus twice the diameter of the balls, plus the size of the material required for holding the whole together, that is for providing the plate with the wave guide hole and the cylindrical holes for accomodating the balls. In addition, should the above mentioned joint be remarkably thrust loaded, each of the plates, as urged by the adjacent plate only at a few (generally three) bearing locations for the balls, could become undulated and however carry only a light weight.

It is the main object of the present invention to provide a ball universal joint for wave guides, which is of minimized size and very rugged.

It is another object of the invention to provide a wave guide of the above design, which exhibits very good electrical and mechanical performances and can be coupled as a unit with further wave guides of the same design.

These and still other objects are accomplished by a ball universal joint for wave guides, comprising a stack or pack of plates overlapping one another, each plate provided with a hole of rectangular cross-section forming the wave guide length for a single step, an end plate at each end of said plate stack or pack, a rigid framework retaining said plates compressed on one another by rings of balls arranged between said framework and end plates, a plurality of rings of balls located between said framework and the outer peripheral edge of circular cross-section for said plates, and cylindrical holes of a circular cross-section formed in the plates between said end plates, balls being accomodated in such cylindrical holes and having substantially the same diameter as that of the holes, but a diameter slightly larger than the thickness of the plates at the zones where said holes are provided, the wave guide being characterized in that a rigid body intermediate the plates of said plate stack or pack is fast with said framework, that the end surfaces of the rigid body facing the plates adjacent thereto lie on planes forming a 90° angle therebetween, that in said rigid body a hole of rectangular cross-section is provided having 90° bent axis, said rigid body forming a curved step with curved wave guide length, that each plate intermediate said end plates has an edge of less thickness than that of the plate and that in this edge said cylindrical holes are provided, in which said balls are accomodated, that said cylindrical holes are arranged according to a circular ring, the circular rings along which said cylindrical holes and balls are distributed having a different diameter in one plate relative to the plate adjacent thereto, between each plate and the plate adjacent thereto at least one rigid ring being positioned and abutting on one of the two plates and on the balls accomodated in the holes of the other plate, respectively.

For a better understanding of the structure and features of a ball universal joint for wave guides according to the present invention, an embodiment thereof will now be described by mere way of not limiting example, reference being had to the accompanying drawings, in which.

Figure 1:
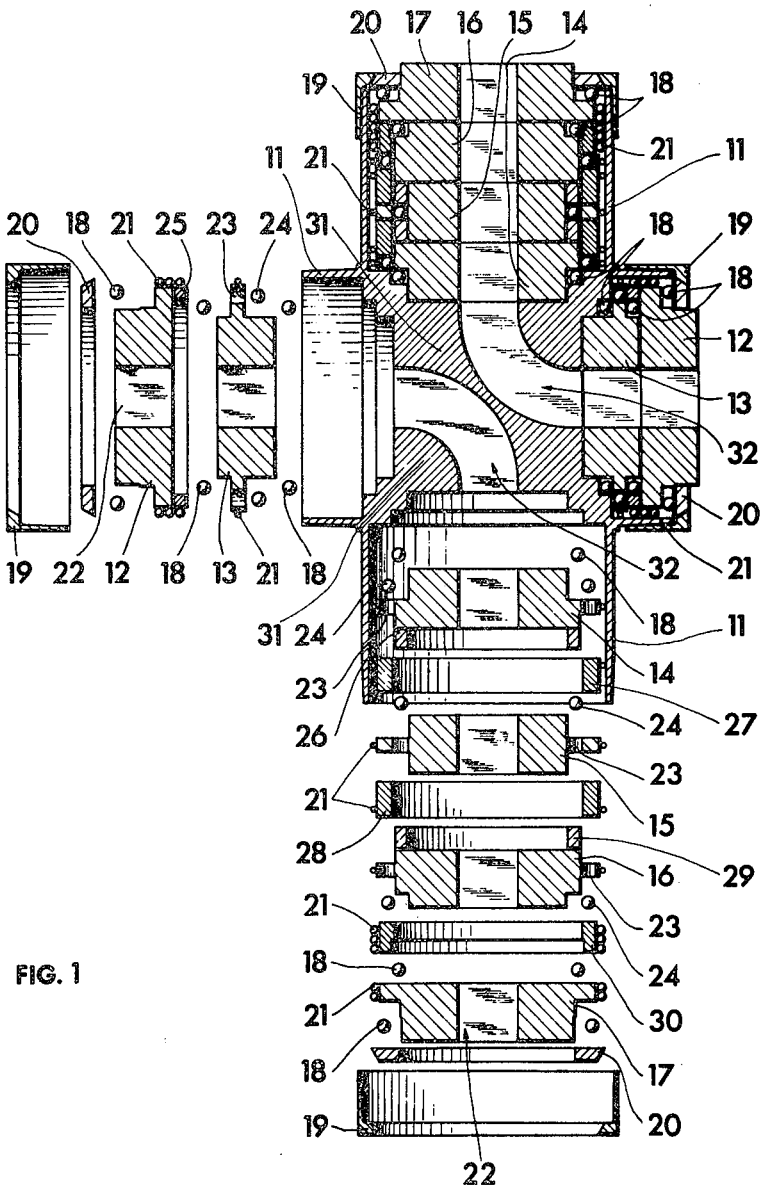
FIG. 1 is an axial sectional and partially exploded view showing a unit comprising two separate ball universal joint wave guides.

In order to understand the operation and structure of the ball univeral joint for wave guides according to the present invention, particular reference will not be had to FIG. 1, showing an axial sectional and partially exploded view of a unit comprising two separate wave guides.

The unit of FIG. 1 comprises a rigid framework 11 defining four cylindrical seats, therein accomodating plates making up four distinct plate stacks or packs. Each of the two wave guides forming part of the unit comprise a stack or pack of plates formed of plates 12 and 13 and a stack or pack of plates formed of plates 14, 15, 16 and 17, respectively. The plates in each assembly of plates of the involved joint are held compressed on one another through ball rings 18 by means of conical forcing ring nuts 19 and washers 20; the washers 20 directly act (through the ball rings 18) on the end plates 12 and 17, respectively, and identical to each other. The plates in said two plate assemblies are freely rotable relative to the rigid structure owing to a plurality of ball rings 21 located between said framework and the outer peripheral edge of circular cross-section of the plates. Each of the plates in the two plate assemblies are provided with a hole 22 of rectangular cross-section forming the wave guide length of a single step.

As shown in FIG. 1 and FIGS. 5, 6 and 7, each intermediate plate between the end plates 12 and 17, respectively, for a wave guide (that is, the intermediate plates 13, 14, 15 and 16) has an edge of less thickness than that of the plates, in said edge cylindrical holes being provided, all of which have been designated for simplicity by reference numeral 23, having accomodated therein balls 24 substantially of the same diameter as the holes, but of a slightly larger diameter than the thickness of the plates at said reduced thickness edges. All of the several plates 12, 13, 14, 15, 16 and 17 are restrained to one another by rings 25, 26, 27, 28, 29 and 30, respectively, which when the joint is assembled will each abut on one of the two adjacent plates and respectively on the balls 24 accomodated within the holes 23 of the plate adjacent to that being considered. A rigid body 31 forms part of the rigid framework 11 and is positioned intermediate the above described two stacks or packs of plates and has the end surfaces facing the plates 13 and 14, respectively, lying on planes forming a 90° angle therebetween. In the rigid body 31 there are provided two holes 32 (one for each of the two wave guides forming part of the unit shown in the drawing) having a rectangular cross-section and 90° bent axis, this rigid body forming a curved step with curved wave guide length. The thickness of the steps or plates is a quarter-wave and the average length for the curved holes of rectangular cross-section 32 is half-wave, the whole appearing as a wideband filter. In all the band ranging from 9 to 12.4 GHz, this universal joint wave has at any angle a standing wave ratio lower than 1.05. The wave guide components are made of steel, which is silver-plated at the guides, thus providing that the insertion losses are lower than 0.05 db.

Owing to the provision of the balls 24, on operation the several plates of the joint proportionally rotate in the same manner (as described in detail in the U.S. Pat. No. 3,786,378 to the same applicant), as between two rings rotates the ball carrying cage of any thrust ball bearing.

In any ball step joint, each of the plates perform two functions both as a ball carrying cage and as a ring, and thus all of the plates in a same stack or pack of plates are interconnected and proportionally rotate; for example, should the plate 17 rotate through 40°, as a result plate 16 would rotate through 30°, plate 15 through 20° and plate 14 through 10°, while the curved central step 31 would be stationary. Obviously, the plates in each stack or pack of plates can be readily provided with stop members restricting the amplitude of the maximum rotation, generally for a rotation of ± 60° for the horizontal movements effected by the stack or pack comprising the plates 14 through 17, and for a rotation of ± 40° for the vertical movements effected by the plates 12 and 13.

Figure 2:
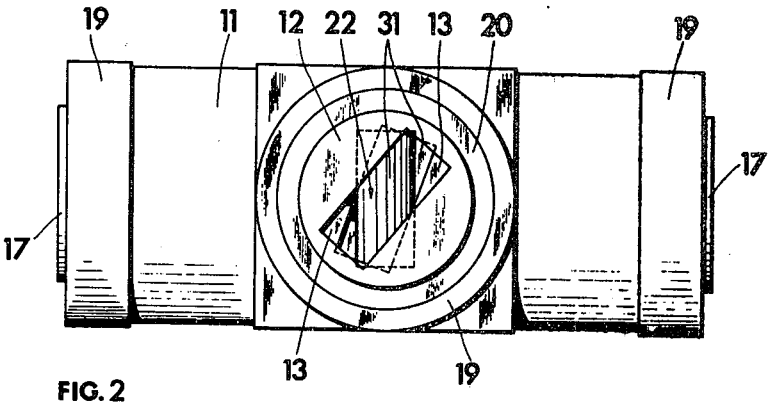
FIG. 2 is a side elevational view for the joint, seen from the right in FIG. 1, wherein the plates of a guide are rotated relative one another.
Figure 3:
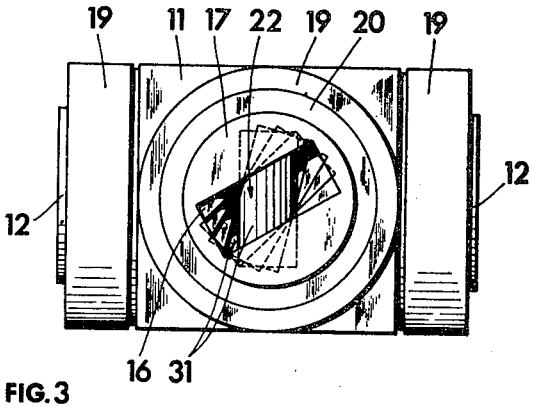
FIG. 3 is a plan view of the joint, and more particularly a view from top to bottom for the joint of FIG. 1, also in this case the joint plates being rotated to one another.
Figure 4:
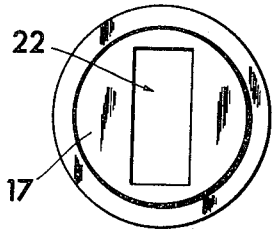
FIGS. 4 through 7 are plan views showing four of the plates forming part of the wave guides for the unit of FIG. 1.
Figure 5:
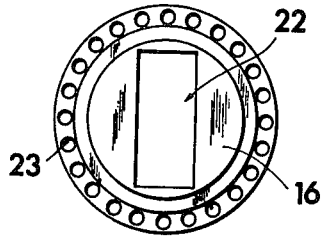
Figure 6:
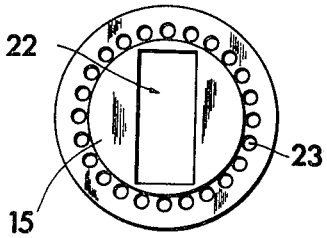
Figure 7:
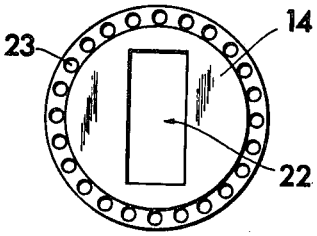

In FIGS. 1, 5, 6 and 8, it will be seen that the circular rings, along which the cylindrical holes 23 are distributed, are of different diameter in one plate relative to the plate adjacent thereto in the joint. While in FIG. 1 the plates in each of the plate stacks or packs are not rotated relative to one another, in FIGS. 2 and 3 such plates have been shown rotated so that the wave guides defined thereby take a spiral step pattern. As apparent, instead of comprising two separate ball universal joint wave guides, as shown in FIG. 1 (where one of the two wave guides has been shown in exploded view, while the other has been shown assembled and ready for operation), provision could be made for only one wave guide having all of the above mentioned features.

What I claim is:

1. A ball universal joint for waveguides comprising:

a stack of circular plates including end plates on each end of said stack and intermediate plates between said end plates, each of said circular plates having a hole of rectangular cross-section extending therethrough and forming a waveguide step, each of said intermediate plates having a thin peripheral portion with a plurality of cylindrical holes extending therethrough arranged in a circular ring around the axis of its respective intermediate plate, the diameters of said circular rings on adjacent intermediate plates being different from each other;

a rigid body positioned between two of said intermediate plates and having at least one pair of end surfaces lying in planes at 90° to each other and facing respective ones of said two intermediate plates, said rigid body having at least one curved hole of rectangular cross-section extending between said two end surfaces and forming a curved waveguide step;

a rigid framework fast with said body and coupled to said end plates to hold said circular plates and said body in stacked compressed relation one on another;

rings of end balls between said framework and said end plates for axially coupling said framework to said end plates while permitting axial rotation of said circular plates;

rings of peripheral balls between the outer circular periphery of said circular plates for radially coupling said framework to said circular plates while permitting axial rotation of said circular plates;

an intermediate plate ball located in each of said cylindrical holes, said intermediate plate balls having substantially the same diameter as said cylindrical holes but having a larger diameter than the thickness of its respective thin peripheral portion; and at least one rigid ring between adjacent ones of said circular plates, said ring abutting one of said adjacent plates and said intermediate plate balls in the cylindrical holes of the other of said adjacent ones of said circular plates.

2. The ball universal joint as claimed in claim 1, wherein said rigid body has two of said curved holes of rectangular cross-section and two pairs of said end surfaces coupled to two stacks of said circular plates with associated framework, balls, and rings, whereby two distinct ball universal are provided in said rigid body.

3. The ball universal joint as claimed in claim 2, wherein the thickness of each of said circular plates is one quarter wave, and the length of said curved holes is one half wave.

* * * * *